United States Patent [19]

Walker

[11] Patent Number: 4,991,244

[45] Date of Patent: Feb. 12, 1991

[54] BORDER FOR AIR BED

[76] Inventor: Robert A. Walker, 11010 89th Ave. North, Maple Plain, Minn. 55369

[21] Appl. No.: 461,304

[22] Filed: Jan. 5, 1990

[51] Int. Cl.[5] ..... A47C 27/10

[52] U.S. Cl. ..... 5/400; 5/449; 5/470; 5/474

[58] Field of Search ..... 5/449, 451, 452, 470, 5/474, 400

[56] References Cited

U.S. PATENT DOCUMENTS

| | | | |
|---|---|---|---|
| 1,730,752 | 10/1929 | Withers . | |
| 2,691,179 | 10/1954 | Kann . | |
| 3,128,480 | 4/1964 | Lineback . | |
| 3,735,432 | 5/1973 | Kreten et al. | 5/451 X |
| 3,736,604 | 6/1973 | Carson, Jr. | 5/451 X |
| 4,187,566 | 2/1980 | Peterson | 5/474 X |
| 4,224,706 | 9/1980 | Young et al. . | |
| 4,306,322 | 12/1981 | Young et al. . | |
| 4,394,784 | 7/1983 | Swenson et al. | 5/474 X |
| 4,637,082 | 1/1987 | Moore et al. | 5/452 |
| 4,682,378 | 7/1987 | Savenije . | |
| 4,713,852 | 12/1987 | Fox, Sr. et al. | 5/474 X |
| 4,879,775 | 11/1989 | Keefer | 5/451 X |
| 4,890,344 | 1/1990 | Walker . | |
| 4,897,890 | 2/1990 | Walker . | |

FOREIGN PATENT DOCUMENTS

55837/80 2/1979 Australia .

*Primary Examiner*—Michael F. Trettel

*Attorney, Agent, or Firm*—Burd, Bartz & Gutenkauf

[57] ABSTRACT

An air bed has side-by-side air mattresses confined within the perimeter of a rectangular border. The border has a plurality of border walls each located within a fabric case. The case accommodates upper and lower foam members of different density. The upper foam member has a density so as to be sufficiently resilient reducing discomfort to a resting person. The lower foam member has a density so as to be sufficiently rigid to retain the air mattresses within the perimeter of the border. Velcro fasteners are used to normally join the border walls. The bed is equipped with a cover having a releasable fastener so that the cover may be readily removed from the air mattresses and border.

16 Claims, 5 Drawing Sheets

FIG. 1
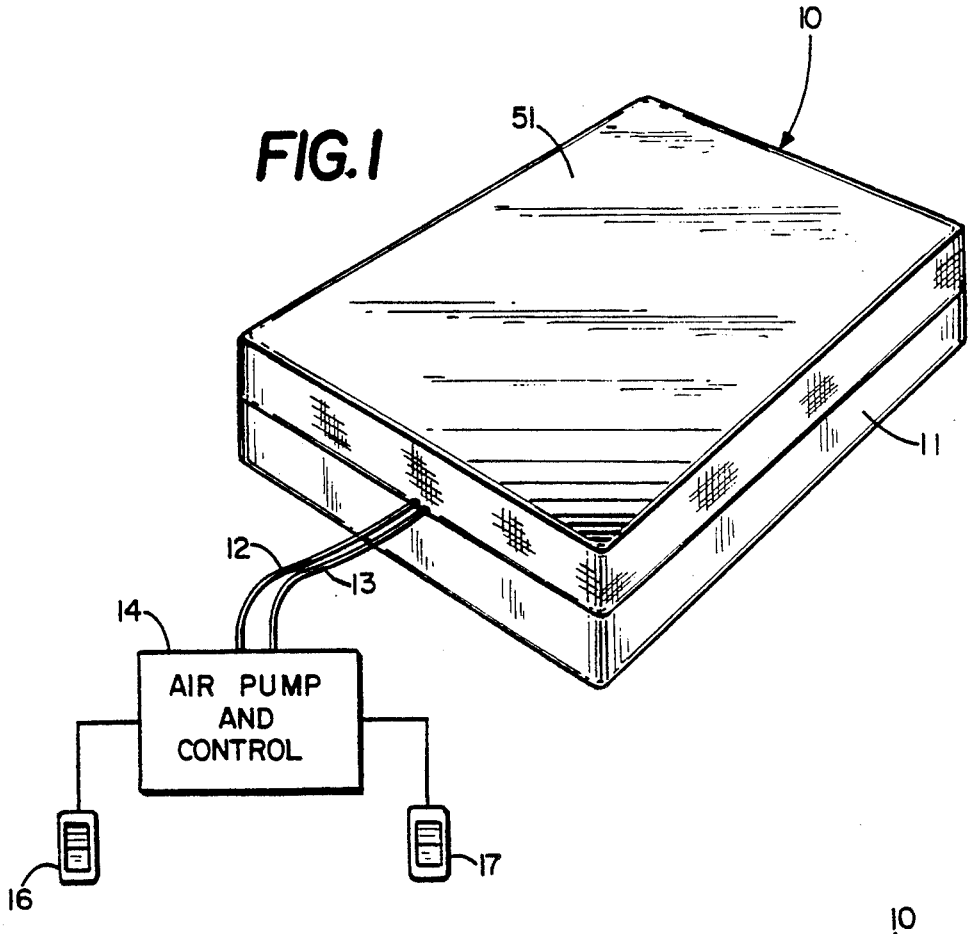
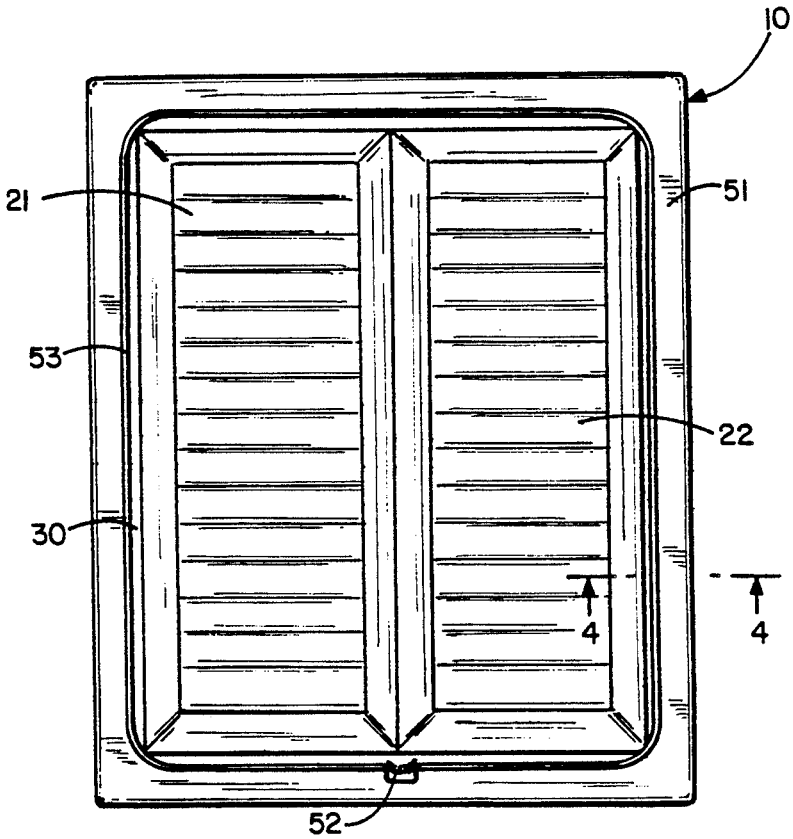
FIG. 2

BORDER FOR AIR BED

FIELD OF INVENTION

This invention relates to inflatable body supports, such as air beds, having one or more air mattresses confined within a frame or border structure.

BACKGROUND OF INVENTION

Cots and beds using air mattresses to provide yieldable body supports are known in the art. For example, Young et al in U.S. Pat. No. 4,306,322 and Swenson et al in U.S. Pat. No. 4,394,784 disclose air bed assemblies having a pair of pneumatic bladders confined within an outer perimeter of four longitudinally extending foam rubber blocks. The air bladders and blocks are enclosed within a cover. These air bed assemblies do not have a border which uses top and bottom foam members of different density whereby the bottom member is sufficiently rigid to confine the air bladders within the perimeter of the border and the top member is sufficiently resilient to comfortably support a resting body.

Savenije in U.S. Pat. No. 4,682,378 discloses an air mattress assembly having edge strips of foam material extending around an air chamber. A top layer of foam material is secured to the edge strips to enclose the air chamber. The air bed of Savenije, however, suffers from the disadvantage that the resiliency and comfort of its edge strips is limited so as to sufficiently confine the air chamber within its perimeter.

SUMMARY OF INVENTION

The invention is a fluid accommodating apparatus or air bed providing a support for a body, such as a human body. The air bed has a pair of side-by-side mattresses preferably accommodating air under pressure, such as 1 psi or less. Each air mattress has a pressure relief valve connected to one end thereof operable to insure that the air pressure within the mattresses is maintained below a predetermined value so as not to overinflate the mattresses and thereby prevent seam separation and rupture of the walls of the air mattresses. The mattresses are adapted to be coupled to an air pump and control operable to provide a supply of air under pressure to the mattresses and allow air to exhaust from the mattresses. A border surrounding the outer perimeter of the air mattresses functions to comfortably support a body resting on the border and to confine the air mattresses within the border thereby limiting outward expansion of the end and side walls of the air mattresses. A cover having a releasable closure is located over the air mattresses and border.

According to a preferred embodiment of the invention, there is provided an air bed assembly having a pair of side-by-side air mattresses for accommodating air under pressure for supporting a body. A border surrounding an outer perimeter of the air mattresses has an upper end wall, a lower end wall and side walls to form a generally rectangular frame. Each of the walls has a first top layer of foam material that is sufficiently resilient so as to comfortably support a body resting thereon. The top layer is mounted on a second bottom layer of foam material that is sufficiently firm so as to confine the air mattresses within the frame limiting outward expansion of the side and end walls of the air mattresses. The first and second layers are generally elongated block members. The foam material of the first layer has a lower density than the density of the second layer. A fabric case encloses the first and second layers in a tight fitting relation. A plurality of releasable hook and loop fasteners connected to adjacent portions of the border walls cooperate to normally join the walls together. This provides for quick and easy assembly and disassembly of the border. A cover mounted over the air mattresses and border holds the border and air mattresses together. The cover has a top guilt jointed to a bottom sheet. A releasable closure, such as a zipper, secures the bottom sheet to the sides of the cover. Another releasable closure, such as a draw cord can be used to hold the cover over the border and air mattresses. The releasable closures can be opened so that the cover may be readily removed from the air bed. One-way air pressure relief valves are connected to the ends of the air mattresses opposite the air inlet to prevent over-inflation of the air mattresses. A foundation or base supports the air mattresses and border.

DESCRIPTION OF DRAWING

FIG. 1 is a perspective view of the air mattress assembly of the invention connected to an air pump and control;

FIG. 2 is a bottom view of the air mattress assembly of FIG. 1;

DESCRIPTION OF PREFERRED EMBODIMENTS

Referring to FIG. 1 and 2, there is shown a fluid accommodating air mattress assembly having a border of the invention indicated generally at 10 usable to yieldably support an object. Assembly 10 accommodates a compressible fluid, such as air or other gases, to yieldably support an object in a horizontal position. The assembly is preferably an air bed used to yieldably support one or more prone persons.

Air mattress assembly 10 has a pair of generally rectangular air mattresses 21 and 22. The details of air mattresses 21 and 22 are disclosed in U.S. Pat. No. 4,908,895, incorporated herein by reference. Air mattresses 21 and 22 have a rectangular box shape with generally flat sides and ends. The walls of air mattresses 21 and 22 are made of Nylon vinyl, polyester, Rayon vinyl or cotton rubber materials. These materials are flexible, strong, and air impervious. They also do not deteriorate over time and are water-resistant. Fluid impervious continuous connections or seams permanently join peripheral adjacent portions of the walls of air mattresses 21 and 22 together. The seams are lap seams forming the outer peripheral edges of the air mattresses. The seams are formed by known ultrasonic and heat sealing methods. Air mattresses 21 and 22 are used side by side as a dual system. A single air mattress can be used for a single size air bed. Assembly 10 is supported on a generally rectangular box shaped foundation 11. Foundation 11 has a width and length substantially the same as the width and length of air mattress assembly 10.

Figure 5:
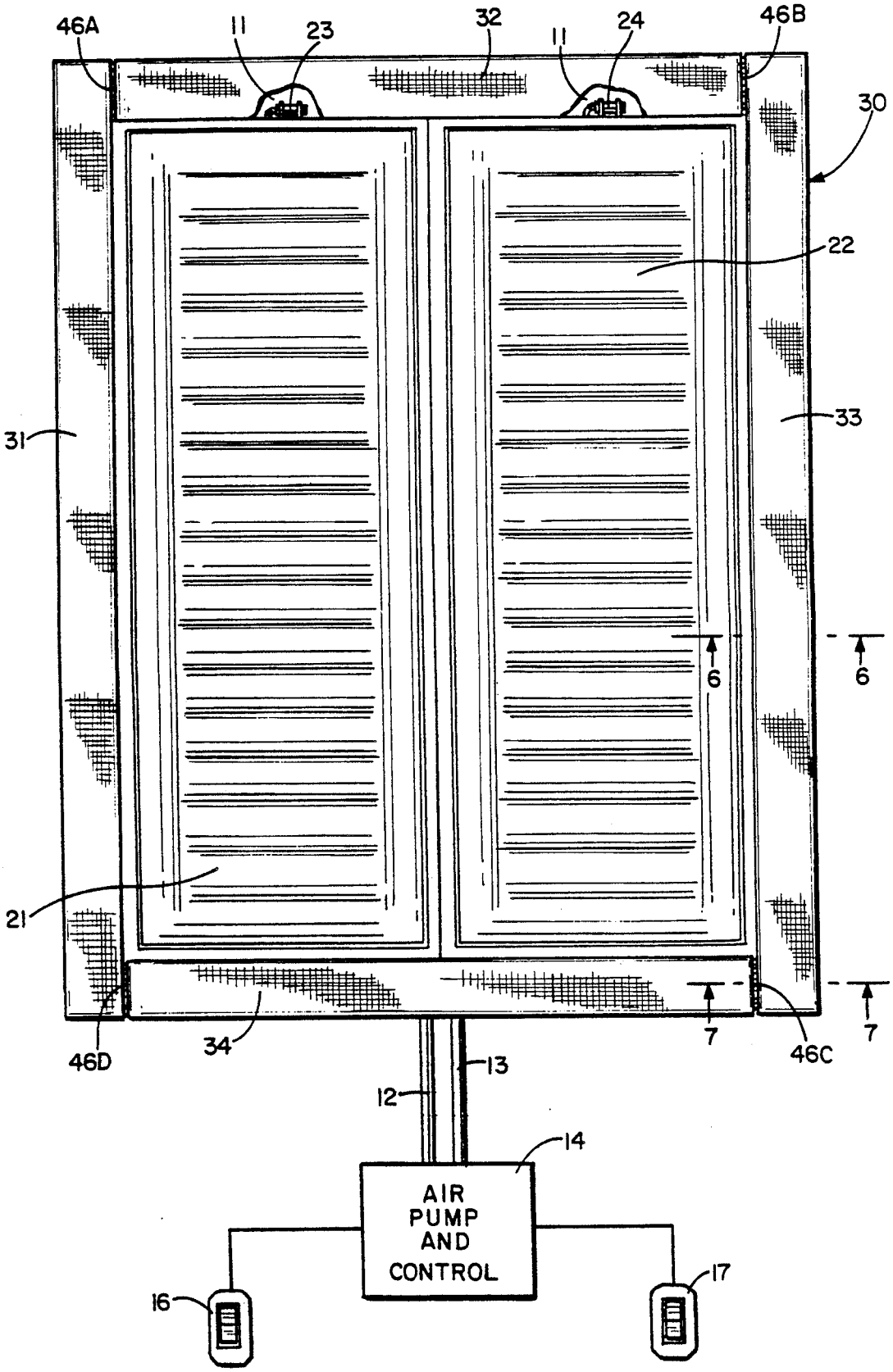
FIG. 5 is an enlarged top view of the air mattress assembly of FIG. 1 without its cover.
Figure 10:
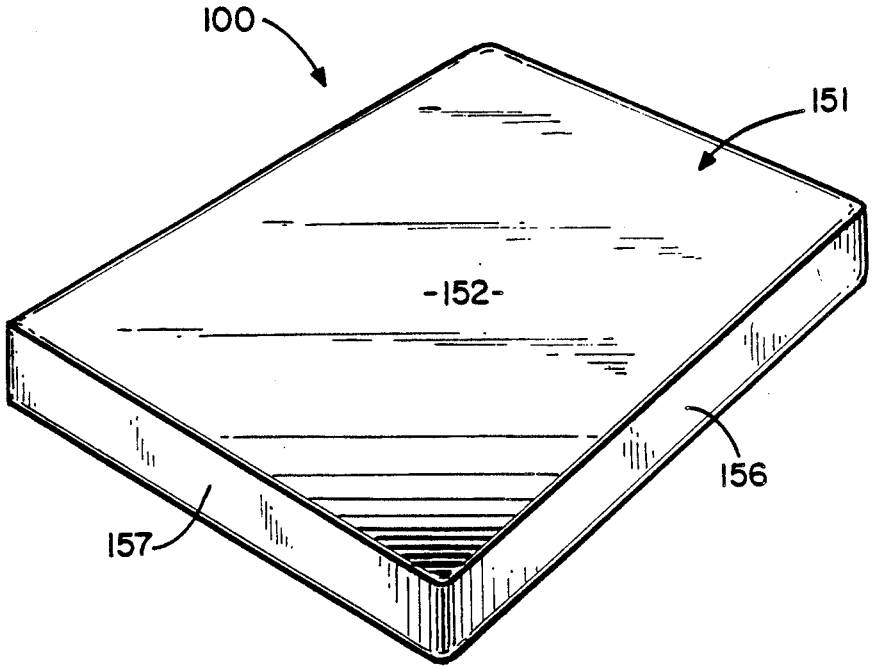
FIG. 10 is a perspective view of a modification of the air mattress assembly of the invention.

Referring to FIGS. 1 and 5, air mattress assembly 10 is connected to an air pump and control 14 operable to supply the air mattresses 21 and 22 with air under pressure and allow air to exhaust from the air mattresses. The details of air pump and control 14 are disclosed in U.S. Pat. No. 4,829,616, incorporated herein by reference. Air pump and control 14 has a pump and hand-operated switches 16 and 17 for regulating valves and the pump to supply air to air mattresses 21 and 22. One end of a first elongated hose 12 is attached to a first air outlet member of air pump and control 14. One end of a second elongated hose 13 is secured to a second air outlet member of air pump and control 14. Hoses 12 and 13 are elongated flexible and elastic plastic tubes each having a continuous passage. Hose 12 carries air between air pump and control 14 and mattress 21. Hose 13 carries air between air pump and control 14 and air mattress 22. The air pump and control 14 has an electric motor (not shown) that is coupled to a source of power. Remote hand-operated switch 16 is used to control the operation of the electric motor. The motor drives a fan or impeller that moves air under pressure to hose 12 and into the chamber of air mattress 21. Remote hand-operated switch 17 is used to control the operation of the motor whereby air under pressure is moved through hose 13 and into the chamber of mattress 22. A person lying on air mattresses 21 and 22 can utilize switches 16 and 17 to operate air pump and control 14 to increase the pressure of the air in the air mattresses or cause the air in the mattresses to be evacuated to the atmosphere, thereby adjusting the firmness of the air mattresses.

Referring to FIG. 5, a first L-shaped tube assembly 23 is connected to one end of air mattress 21. Tube assembly 23 is at one end of air mattress 21 while hose 12 is connected to the other or opposite end of air mattress 21. A second L-shaped tube assembly 24 is secured to one end of mattress 22. Tube assembly 24 is at the end of air mattress 22 opposite from the end of mattress 22 connected to hose 13. Tube assemblies 23 and 24 are used as outlet passageways to allow air to flow out of the chambers of mattresses 21 and 22.

Each tube assembly 23 and 24 accommodates a pressure relief valve (not shown) operable to maintain a predetermined maximum air pressure in the chambers of mattresses 21 and 22. An example of a pressure relief valve is shown in U.S. Pat. No. 4,208,895 incorporated herein by reference. The pressure relief valves prevent over-inflation of air mattresses 21 and 22, which can cause wall rupture and seal and seam separation. Preferably, the maximum air pressure is about 1 psi. An air pressure exceeding 1 psi will open the pressure relief valves allowing air to exhaust from air mattresses 21 and 22 through tube assemblies 23 and 24 to the atmosphere, thereby relieving the pressure of the air within mattresses 21 and 22.

Air pressure relief valves operable to open in response to air pressures below 1 psi can be used with air mattresses 21 and 22. Air pump and control 14 is used to supply air under pressure to the mattresses. Hand controls 16 and 17 are used to control the air pump and control 14, thereby regulating the supply of air to and exhaust of air from the mattresses and the pressure of the air within the mattresses. When the air pressure within the mattresses drops below the maximum value, such as 1 psi, the pressure relief valves will automatically close. The pressure relief valves prevent over-inflation of air mattresses 21 and 22 and seam and seal separation and bursting of the mattress walls due to sudden pressure shocks imparted to air mattresses 21 and 22.

Referring to FIGS. 4 to 7, a frame or border indicated generally at 30 surrounds the outer sides and ends of air mattresses 21 and 22. Border 30 has a pair of elongated side walls 31 and 33 joined together with upper and lower end walls 32 and 34. Border walls or sections 31 to 34 form a generally rectangular cavity that accommodates air mattresses 21 and 22 in a tight fitting relation. Assemblies 23 and 24 project from the ends of air mattresses 21 and 22 between the lower surface of border end wall 32 and the top surface of foundation 11. This conceals tube assemblies 23 and 24 thereby protecting the operation of the pressure relief valves contained therein.

Border side walls 31 and 33 and end walls 32 and 34 have substantially the same structure and function. The following description is directed to side wall 33 and end wall 34. Side wall 33 has foam plastic members 36 and 37 located in an outer fabric case 38. Top foam member 36 is a generally rectangular block of soft density material. The material of foam member 36 is sufficiently resilient to comfortably support a body resting thereon. Bottom foam member 37 is a generally elongated rectangular block of hard density material, such as polyurethane. Bottom member 37 has a width the same as the width of top member 36. The material of foam member 37 is sufficiently firm to support the side wall 26 of air mattress 22. Case 38 surrounds top and bottom foam members 36 and 37 in a tight fitting relation. A zipper 39 secured to the ends of the case 38 is used to retain the case 38 on members 36 and 37.

Figure 7:
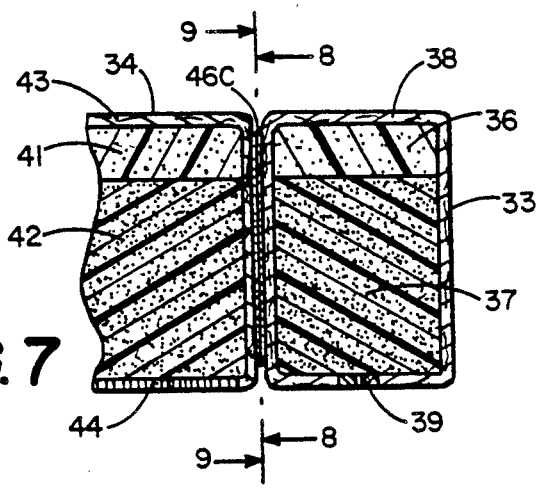
FIG. 7 is an enlarged sectional view taken along line 7—7 of FIG. 5.
Figure 8:
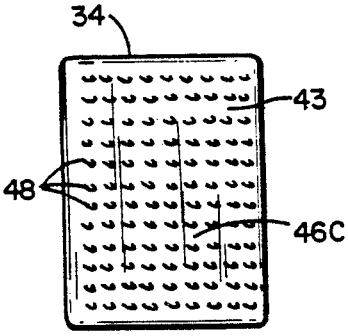
FIG. 8 is a sectional view taken along line 8—8 of FIG. 7.
Figure 9:
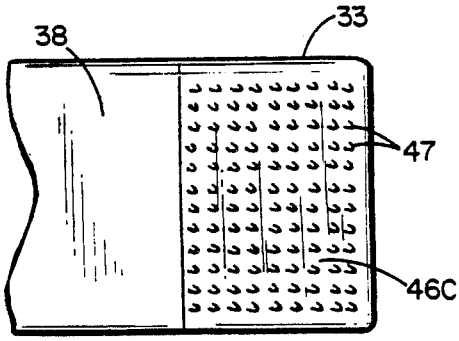
FIG. 9 is a sectional view taken along line 9—9 of FIG. 7.

End wall 34 has a top foam member 41 and a bottom foam member 42 located within a fabric casing 43. Members 41 and 42 are generally rectangular blocks of different density. Top foam member 41 consists of a soft density material so as to be sufficiently resilient to comfortably support an object in contact with the top of end wall 34. Bottom foam member 42 is made of a hard density material that provides firm support for the end walls of air mattresses 21 and 22. Foam members 36,41 and 37,42 can be either open or closed cell polyurethane foam blocks. The upper foam member 36,41 has an inverse load deflection value of 1.0–3.0. The lower foam member 37,42 has an inverse load deflection value of 1.8–7.0. Other types of resilient materials and inverse load deflection values can be used for border 30. As shown in FIG. 7, upper foam members 36 and 41 have a thickness or vertical dimension of about one third the thickness or vertical dimension of lower foam members 37 and 42. Case 43 surrounds the top and bottom foam members 41 and 42 of border end wall 34. Case 43 has a zipper 44 that is used to hold case 43 in a tight fitting relation around foam members 41 and 42.

Border walls 31 to 34 cooperate to provide firm support for the outer walls of air mattresses 21 and 22. The bottom foam members of border walls 31 to 34 are made of high density foam plastic material so as to limit outward expansion and bulging of the air mattresses 21 and 22. Border walls 31 to 34 also allow a person to comfortably rest on all top areas of mattress assembly 10. The top foam members of the border walls 31 to 34 consist of low density, soft foam plastic material that conforms to the shape of a person lying on top of the border walls.

Referring to FIGS. 5 and 7 to 9, a plurality of hook and loop fasteners 46A–46D, known as VELCRO fasteners, are used to join border walls 31–34. Border side wall 33 is connected to border end wall 34 with VELCRO fasteners 46C. VELCRO fastener 46C have a plurality of hooks 47 secured to case 38 that cooperate with a plurality of loops 48 on case 43 to connect border side wall 33 and border end wall 34. Hooks 47 are attached to the side of case 38 adjacent an end of wall 33. Loops 48 are secured to the end of case 43. Hooks 47 engage loops 48 to attach border side wall 33 generally normal to border end wall 34. The upper end of border wall 33 is in general alignment with the outer side surface of border wall 34, as shown in FIG. 5. VELCRO fasteners 46B are used to normally connect border side wall 33 with border end wall 32. The lower end of border wall 33 is aligned with the outer side surface of border wall 32. Border side wall 31 is normally secured to border end walls 32 and 34 with VELCRO fasteners 46A and 46D. The ends of border wall 31 are in general alignment with the outer side surfaces of border walls 32 and 34. Other types of fasteners can be used to join border walls 31 to 34. Border 30 forms a generally rectangular frame structure located around the perimeter of the side-by-side mattresses 21 and 22 in a tight fitting relation. VELCRO fasteners 46A to 46D used to join border walls 31 to 34 allow air bed 10 to be readily assembled and disassembled. This facilitates moving of bed 10 from one location to another. Border 30 functions to confine air mattresses 21 and 22 and also to provide comfort to a person resting on air bed 10.

Figure 3:
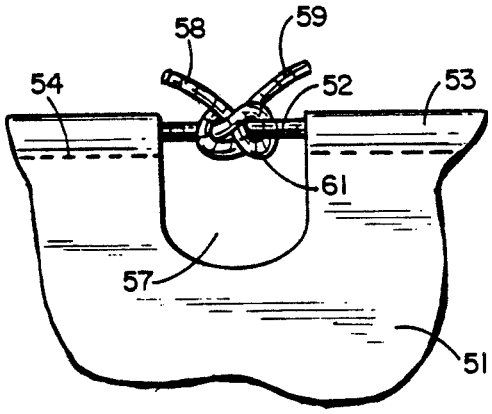
FIG. 3 is an enlarged partial view of the cover of the air mattress assembly of FIG. 1 showing the draw string and knot thereof.
Figure 4:
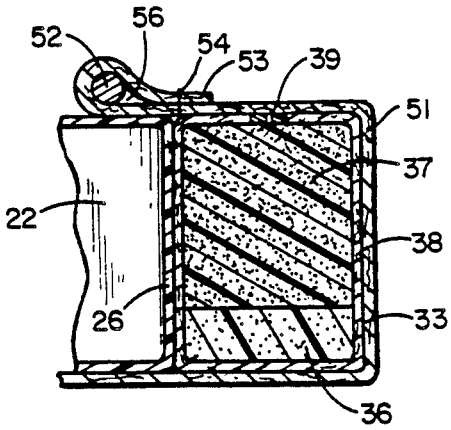
FIG. 4 is an enlarged sectional view taken along the line 4—4 of FIG. 2.
Figure 6:
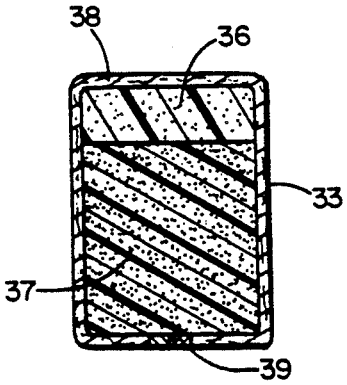
FIG. 6 is an enlarged sectional view taken along line 6—6 of FIG. 5.

Referring to FIGS. 1 to 4, mattress assembly 10 has a cover 51 enclosing air mattress 21 and 22 and border 30. Cover 51 has a draw cord 52 that enables the cover to be drawn tightly around air mattresses 21 and 22 and border 30. This provides additional support to the air mattresses and border. Loosening draw cord 52 allows cover 51 to be readily removed from air bed 10 whereby assembly and disassembly of the air bed and cleaning of the cover is facilitated. Further, the air mattresses 21 and 22 are readily accessible if servicing and repair is needed. End 53 of cover 51 is folded outwardly and secured to an inner area of the cover at 54 to provide a cavity 56 accommodating draw cord 52, as shown in FIG. 4. Cover 51 has a U-shaped opening 57 so that ends 58 and 59 of cord 52 are accessible. Ends 58 and 59 of cord 52 are tied into a knot 61 to hold cover 51 on the air bed 10. Untying knot 61 allows cord 52 to be loosened whereby cover 51 can be removed from air bed 10.

Referring to FIGS. 10 to 13, a modification of the air mattress assembly of the invention, indicated generally at 100, has a pair of air cores or mattresses 21 and 22 surrounded with a border members 31, 33, and 34. The border is located around the outer periphery of the side-by-side air mattresses 21 and 22. The arrangement of air mattresses 21 and 22 and border 30 is shown in FIG. 5. The structure of air mattresses 21 and 22 and border 30 has previously been described.

A cover designated generally at 151 is located about air mattresses 21 and 22 and border 30 to retain border 30 around the side-by-side air mattresses 21 and 22. Cover 151 has a quilted top 152 including a resilient core 153, such as foam plastic, fiber fill, and the like. Downwardly directed side walls 154 and 156 and end walls 157 and 158 secured to the outer edges of top 152 surround border 30. A bottom wall 159 of a sheet fabric material is located under air mattresses 21 and 22 and border 30. A releasable connector shown as a zipper 161 follows a U-shaped pattern adjacent the sides and one end of bottom wall 159. Zipper 161 has a tab 162 used to open and close the zipper. When zipper 161 is open, the center portion of bottom wall 159 can be folded away from air mattresses 21 and 22 so that the air mattresses 21 and 22 and border 30 can be inserted into or removed from cover 30.

Figure 13:
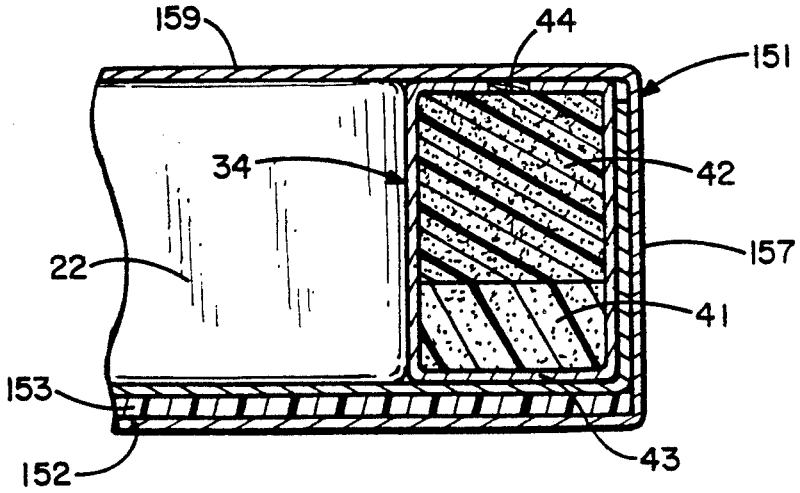
FIG. 13 is an enlarged sectional view taken along 13—13 of FIG. 11.
Figure 11:
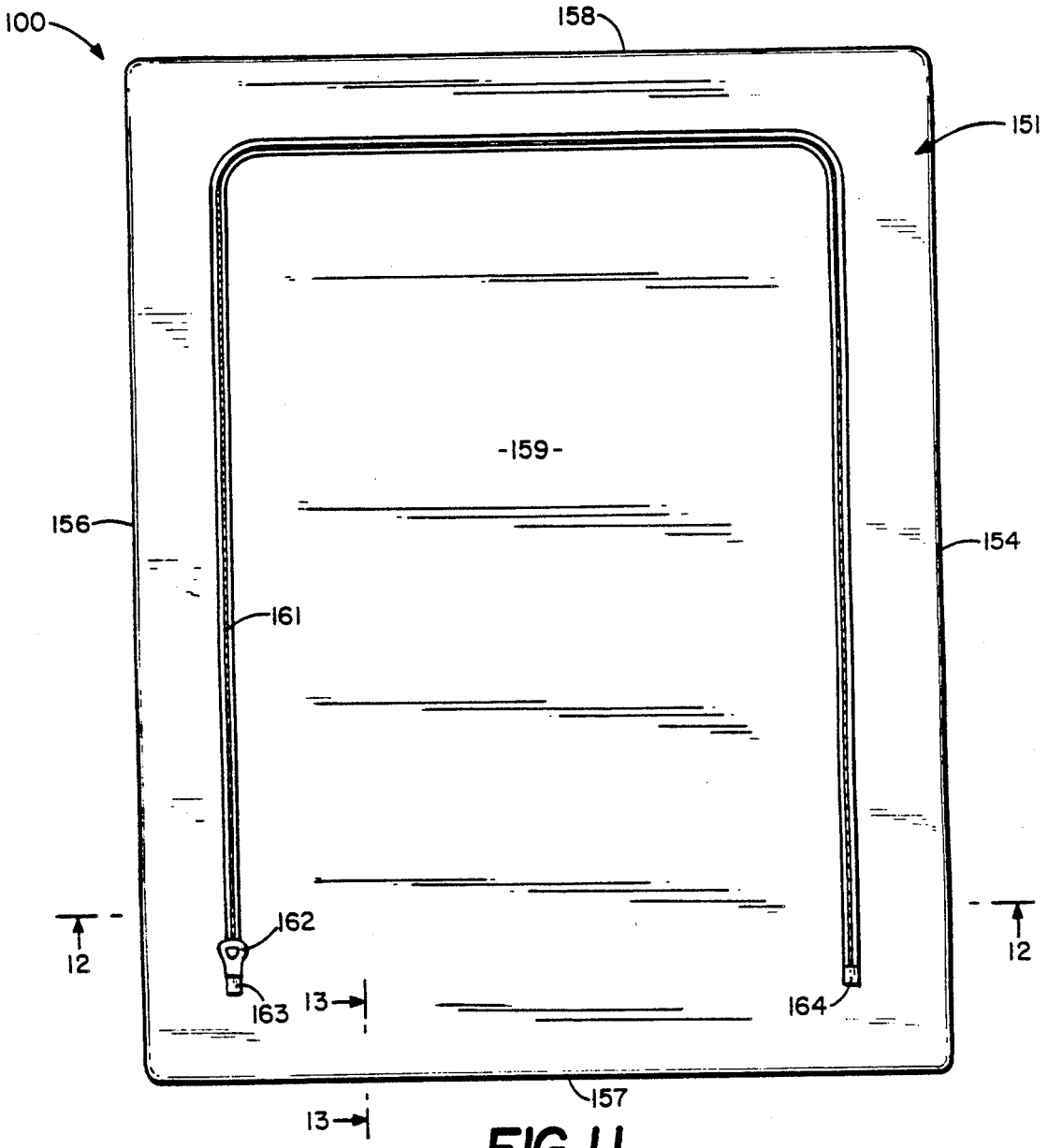
FIG. 11 is an enlarged bottom view of the air mattress assembly of FIG. 10.
Figure 12:
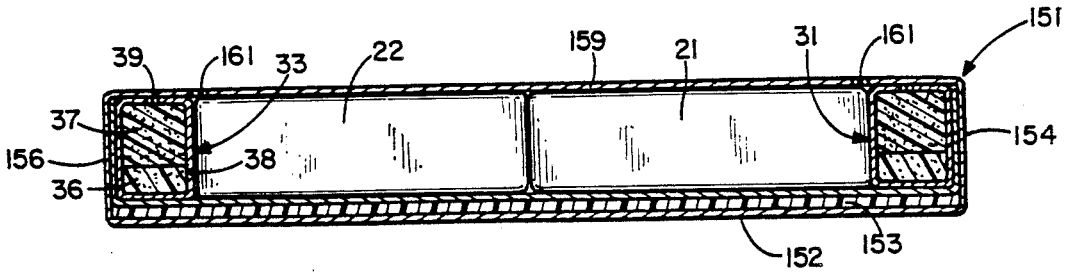
FIG. 12 is an enlarged foreshortened sectional view taken along the line 12—12 of FIG. 11.

As shown in FIG. 11, zipper 161 has ends 163 and 164 spaced inwardly from end wall 157. End wall 157 along with top 152, and side walls 154 and 156 form an elongated end pocket for border section 34, as shown in FIG. 13. The material forming the end pocket holds side border sections 31 and 33 in engagement with the ends of border section 34.

The air mattresses assemblies 10 and 100, are shown as having two air cores or mattresses. The air mattress assembly can have a single air mattress surrounded with a border, such as border 30. A cover such as cover 151, of a size to fit over the border and single air mattress encloses the air mattress and border.

While there has been shown and described preferred embodiments of the air bed with border, it is understood that changes in materials, size, shape, and arrangement of structure may be made by those skilled in the art without departing from the invention. The invention is defined in the following claims.

I claim:

1. An air bed for providing support for a body comprising: a base, air mattress means for accommodating air under pressure supported on the base, air pump and control means connected to one end of the air mattress means operable to supply the air mattress means with air under pressure and allow air to exhaust from the air mattress, air pressure relief valve means mounted on an opposite end of the air mattress means operable to maintain air pressure within the air mattress means below a predetermined value, border means surrounding an outer perimeter of the air mattress means, the border means having an upper wall and a lower wall joined to a pair of side walls forming a rectangular frame, each wall having resilient means to comfortably support the body and support means sufficiently rigid to confine the air mattress means within the frame, the resilient means comprising a first layer of a rectangular block foam material having a density sufficiently resilient to comfortably support the body mounted on the support means, the support means comprising a second layer of rectangular block foam material having a density sufficiently rigid to confine the air mattress means within the frame when inflated with air from the air pump, the first layer having a lower density than the density of the second layer, each wall having casing means enclosing the first and second layers, the casing means having means operable to hold the casing means in tight fitting relation around the first and second layers, first fastening means secured to inner side surfaces of opposite ends of each casing means enclosing the side walls, second fastening means secured to each end of each casing means enclosing the upper and lower walls, said first and second fastening means cooperating with each other to normally join the side walls to the upper and lower walls, and cover means removably mounted over the air mattress means and border means.

2. The bed of claim 1 wherein: the air mattress means comprises a pair of air mattresses located in side by side relation.

3. The bed of claim 1 wherein: the first layer has an inverse load deflection value of 1.0 to 3.0.

4. The bed of claim 1 wherein: the second layer has an inverse load deflection value of 1.8 to 7.0.

5. The bed of claim 1 wherein: the cover means has releasable means operable to releasably hold the cover means over the air mattress means and the border means.

6. The bed of claim 1 wherein: the first layer has an inverse load deflection value of 1.0 to 3.0, and the second layer has an inverse load deflection value of 1.8 to 7.0.

7. The bed of claim 1 wherein: the first and second fastening means comprises a plurality of releasable hook and loop fasteners.

8. An air bed for providing support for a body comprising: a base, air mattress means for accommodating air under pressure supported on the base, and border means surrounding an outer perimeter of the air mattress means, the border means having an upper wall and a lower wall joined to a pair of side walls to form a generally rectangular frame, each of the walls having means to comfortably support a resting body and to confine the air mattress means within the frame comprising a first top layer of block foam material sufficiently resilient to comfortably support the body, the first top layer mounted on a second bottom layer of block foam material having a width substantially the same as the width of the first layer and sufficiently firm to confine the air mattress means within the frame, each wall having casing means enclosing the first and second layers, the casing means having means operable to releasably hold the casing means in tight fitting relation around the first and second layers, the casing means enclosing the side walls having first fastening means and second fastening means secured to the casing means enclosing the upper and lower walls, said first and second fastening means cooperating with each other to join the side walls to the upper walls.

9. The bed of claim 8 wherein: the air mattress means comprises a pair of air mattresses located in side by side relation, each air mattress having a first end connected to air pump and control means operable to supply the air mattress with air under pressure and allow air to exhaust from the air mattress, the air mattress having air pressure relief valve means mounted on a second end of the air mattress operable to maintain air pressure within the air mattress below a predetermined value, said border means being sufficiently rigid to confine said air mattresses when inflated with air within said frame.

10. The bed of claim 8 wherein: the first top layer of material has an inverse load deflection value of 1.0 to 3.0, the second bottom layer of material has an inverse load deflection value of 1.3 to 7.0.

11. The bed of claim 8 wherein: the first top layer has a density lower than the density of the second bottom layer.

12. The bed of claim 8 including: cover means removably mounted over the air mattress means and border means, the cover means including releasable means operable to releasably hold the cover means over the air mattress means and the border means.

13. The bed of claim 8 wherein: the first and second fastening means comprises a plurality of releasable hook and loop fasteners.

14. The bed of claim 8 wherein: the air mattress means has air pressure relief valve means operable to maintain air pressure within the air mattress means below a predetermined value.

15. A border for an air bed having air mattress means for accommodating air under pressure for providing support for a body comprising: an upper wall, a lower wall, and side walls joined to the upper and lower walls to form a frame for accommodating the air mattress means, fastening means normally securing adjacent portions of the walls together, each of the walls having a first layer of resilient material to comfortably support a body resting thereon, and a second layer of firm material located below the first layer sufficiently rigid so as to limit outward expansion of side and end walls of the air mattresses, the first and second layers comprising generally elongated rectangular blocks of foam material having substantially the same widths, the material of the first layer having a lower density than the density of the material of the second layer, and rectangular casing means surrounding the first and second layers of each wall, the casing means having zipper means operable to releasably hold the casing means in a tight fitting relation around the first and second layers, the fastening means including a plurality of releasable hook and loop fasteners, the one of said fasteners secured to the inner side surfaces of opposite ends of the casing means surrounding the side walls, the other of said fasteners secured to each end of the casing means surrounding the upper and lower walls, the hook fasteners adapted to cooperate with the loop fasteners to normally join the side walls to the upper and lower walls.

16. The border of claim 15 wherein: the first layer has a thickness less than the thickness of the second layer.

* * * * *